United States Patent [19]

Wojcik

[11] Patent Number: 5,020,549

[45] Date of Patent: Jun. 4, 1991

[54] SMOKELESS ASHTRAY WITH CONTROLLED COMBUSTION CHAMBERS

[76] Inventor: Tadeusz P. Wojcik, P.O. Box 1659, Guelph, Ontario, Canada, N1H 6R7

[21] Appl. No.: 198,863

[22] Filed: May 26, 1989

[51] Int. Cl.[5] ..... A45D 4/18

[52] U.S. Cl. ..... 131/231; 131/235.1; 131/241; 131/256; 131/257

[58] Field of Search ..... 131/231, 329, 174, 240.1, 131/241, 242, 235.1, 256, 257

[56] References Cited

U.S. PATENT DOCUMENTS

| | | | |
|---|---|---|---|
| 1,526,695 | 2/1925 | Sandidge | 131/235.1 |
| 3,675,662 | 7/1972 | Askins | 131/240.1 |
| 3,952,753 | 4/1976 | Klingler | 131/235.1 |
| 4,239,049 | 12/1980 | Perry | 131/240.1 |
| 4,241,742 | 12/1980 | Hilding | 131/240.1 |
| 4,390,030 | 6/1983 | Tibbetts | 131/231 |

FOREIGN PATENT DOCUMENTS

| | | | |
|---|---|---|---|
| 837482 | 4/1952 | Fed. Rep. of Germany | 131/235.1 |
| 7713645 | 6/1978 | Netherlands | 131/231 |
| 2193876 | 2/1988 | United Kingdom | 131/231 |

*Primary Examiner*—Richard J. Apley
*Assistant Examiner*—J. L. Doyle

[57] ABSTRACT

A smokeless ashtray with controlled combustion chambers comprising a body of suitable shape and material or suitably integrated combination of materials. A top surface and a bottom surface. An ash collecting cavity integrated with an ashtray wall and the top surface. A number of controlled combustion chambers integrated with the top surface, each having a curved controlled combustion chamber surface, a groove located on the curved controlled combustion chamber surface, and a notch in the ashtray wall.

1 Claim, 1 Drawing Sheet

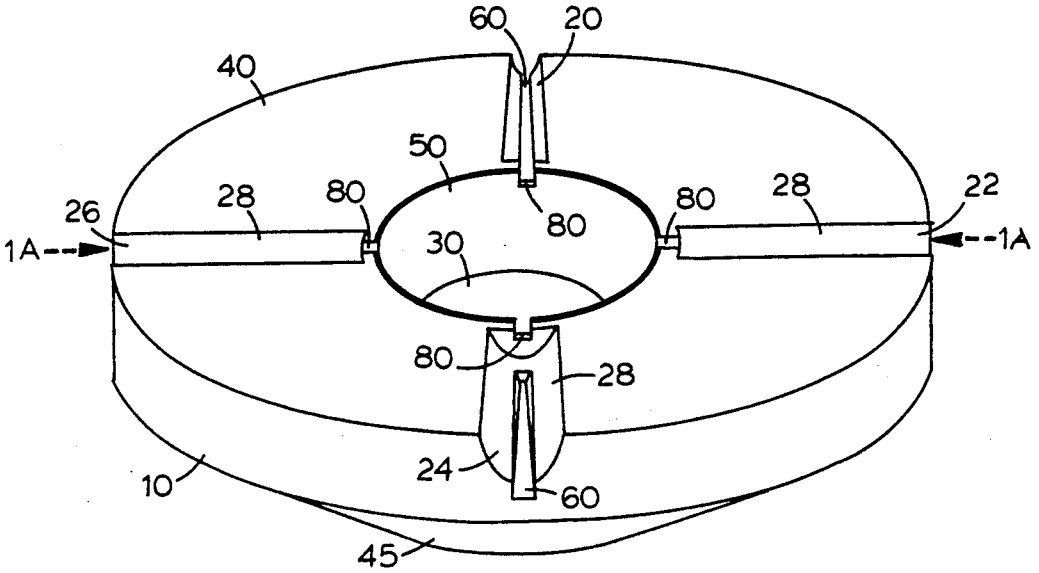
FIG.1
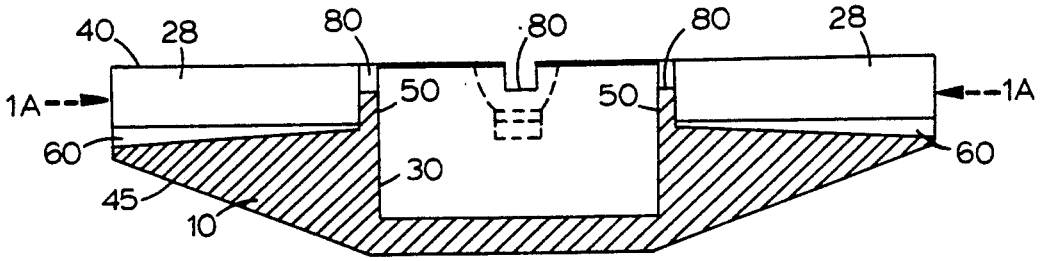
FIG.2
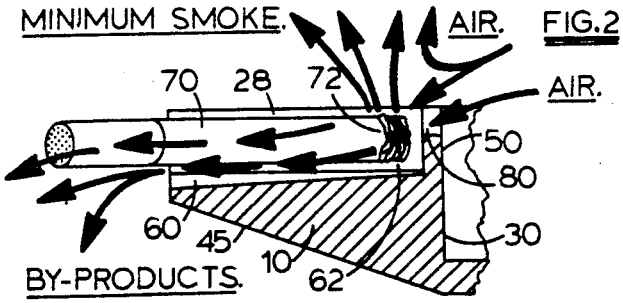
FIG.3
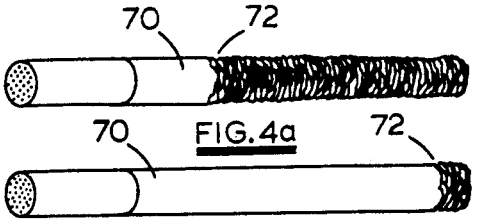
FIG.4a
FIG.4b
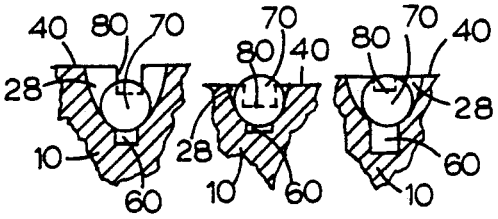
FIG.5a FIG.5b FIG.5c

SMOKELESS ASHTRAY WITH CONTROLLED COMBUSTION CHAMBERS

FIELD OF THE INVENTION

This invention relates generally to a Smokeless Ashtray with Controlled Combustion Chambers (SATCCC), and more particularly to a new and improved device capable of controlling simultaneously the rates at which a temporarily unused cigarette, cigar, or similar smoking article burns itself rapidly producing substantial amounts of smoke.

DESCRIPTION OF THE PRIOR ART

Prior art employed mechanical methods to filter cigarette smoke after it was generated without significantly changing the self burning and smoldering rate of a cigarette,. Although initially satisfactory, such devices had very limited useful lifetime, relatively high purchase and maintenance costs, lacked portability, and lacked differentiation between an ash collecting receptacle and variably controlled combustion chamber for the cigarette, or other smoking article, capable of keeping the cigarette lit but not smoking or burning itself significantly.

SUMMARY OF THE INVENTION

This invention provides a new and improved smokeless ashtray for a cigarette, with a suitable number of controlled combustion chambers for the cigarette and a separate ash collecting cavity. The invention is utilized by placing the lit end of the cigarette in one of the controlled combustion chambers and thereby reducing considerably the rates at which the cigarette burns itself, produces smoke, and most important pollutes the environment. In the invention each controlled combustion chamber has a suitable curved surface, a suitable notch, and a suitable groove in a new and improved arrangement which applies gas dynamics to control combustion and combustion by-products of which visible smoke is the most important and most harmfull pollutant.

BACKGROUND OF THE INVENTION

The invention is especially applicable in situations where nonsmokers and smokers must live and work together in close proximity; but, where ban on smoking is not practical or possible. The nonsmokers will find the SATCCC very useful in reducing to a minimum the amount of unnecessary ambient smoke produced by an unused cigarette. This is due to the fact that smokers often tend to smoke a small fraction of a cigarette allowing the remaining fraction to burn itself freely and pollute the ambient air. At home this issue becomes also very important because it concerns the health and the well being of nonsmoking adult family members, damage caused by smoke to real estate and possessions; but most of all, the effect of smoke on infants and children. At work said problem is also further complicated by the fact that many modern office buildings have insufficient air supply and filtering systems, due to various energy and heat conservation programs, and circulate retained smoke, various pollutants, and harmful microorganisms. This resulted in a number of illnesses and the situation has been given considerable attention.

Furthermore, while this partial smoking is beneficial for the nonsmokers because they in fact smoke less, the nonsmokers and smokers inhale resulting ambient cigarette smoke in sufficient quantities so as to pose a considerable health risk factor for both groups. It has been also suggested that such free burning or smoldering cigarettes have lower combustion temperatures than during the actual smoking and result in incomplete combustion by-products and more harmful polutants. In this case the SATCCC eliminates most of the above problems by keeping the cigarette lit but not burning or smoking significantly.

In addition to the above, the smokers benefit from the invention because the invention does not use energy to function in several selectable and distinct ways, there are no moving parts, and no maintenance is required with the exception of removing collected ashes. Consequently, this eliminates the need to purchase expensive batteries, filters, and worn out parts for similar "smokeless" devices. On the other hand, the cost per year of using such mechanical ashtrays is usually several times the purchase price of an item. The invention has no costs associated with it except the purchase price, and this makes it very economical and desirable. Said mechanical ash trays also have a very limited operational lifetime due to wear-and-tear of nonreplaceable parts, as compared to a practically limitless operational life time for the invention.

Another compounded benefit for the smokers is in the fact that through the use of the SATCCC and relative to the smoking frequency, the smokers will in fact save money on cigarette purchases. By using the SATCCC the cigarette is lit much longer without significantly burning itself; consequently, one cigarette may last over the period in which a smoker would normally smoke two cigarettes. Or for a moderate smoker, this may translate effectively to smoking two out of every three cigarettes. However, the most effective demonstration of how the SATCCC works is by comparison of the self burning rates for cigarettes between SATCCC and a conventional ashtray. After approximately seven minutes the cigarette in the conventional ashtray is almost burned out while the cigarette in the SATCCC is practically intact and lit. Furthermore on the subject, it has been also noticed that some mechanical ashtrays which filter cigarette smoke do in fact increase the self burning rate and consume cigarettes much faster as compared with conventional ashtrays.

OBJECTS OF THE INVENTION

It is according an object of the present invention to provide a controlled combustion chamber for an ashtray to control the combustion rate of a cigarette, cigar, or other smoking article.

It is an object of the present invention to have the controlled combustion chamber (CCC) control the rate of generation of gaseous combustion by-products lighter than air, visible smoke particles, gaseous combustion by-products heavier than air, ash and other matter.

It is an object of the invention to provide a suitable receptacle for collecting ashes.

It is an object of this invention to provide suitable channels and openings on the surface of the CCC's to allow the application of gas dynamics for the control of gaseous combustion by-products heavier and lighter than air, oxygen, and smoke.

Additional object of the invention is to provide selectable means for reduction of costs associated with smoking.

It is an additional object of this invention to provide means for the elimination of smoldering smoke.

It is a further object of the invention to provide several CCC's with different fixed combustion rates at suitable locations in close proximity to the ash receptacle.

It is an essential part of this invention to have a CCC extend over the length of an average cigarette.

Finally, it is an object of this invention to provide a variable combustion rate in a CCC by placing a cigarette burning-end closer or further away from the ash cavity wall.

BRIEF DESCRIPTION OF THE DRAWINGS

Further objects and advantages of the invention will appear from the following detailed description of species thereof and from the accompanying drawings.

In drawings, FIG. 1 is a three dimensional view of the invention.

FIG. 2 is a transverse sectional view of the invention along the plane 1A—1A.

FIG. 3 is a fragmentary sectional view of the invention shown in FIG. 2 on plane 1A—1A thereof.

FIGS. 4*a* and 4*b* how the SATCCC works in relation to an ordinary ashtray, in reducing the self burning rate and the second hand smoke, using burned out cigarettes as an illustrative comparison.

FIGS. 5*a*, 5*b* and 5*c* are illustrations of three controlled combustion chambers with different self burning rates.

DETAILED DESCRIPTION OF PREFERRED EMBODIMENTS

Wile the invention, to be applicable in most situations where smoking occurs; for example, at home, office, vehicle, aircraft, train, etc. may in a trivial fashion have to change in size, shape, or degree, it is illustrated in FIG. 1. generally as being circular in shape and having a body 10 with a suitable ash cavity 30 and an ashtray wall 50. Furthermore, any subsequent variations in thickness, size and shape particularly applicable to a suitable top surface 40 and a suitable bottom surface 45; as well as, any changes necessary to preserve the integrity of the invention while being compliant with said variations, are intended to accommodate divergent environments or user requirements without departing from the essential characteristics of the invention, and technological restrictions imposed by manufacturing materials like glass, metal, some other suitable material, or some suitable combination of materials suitably integrated as the invention.

In addition to the ash cavity 30, the top surface 40 has a suitable number of controlled combustion chambers 20,22,24,26 hereinafter denoted as "CCC", with a suitable number of different but fixed cigarette combustion rates; such that, if a cigarette is placed at relatively the same position in said CCC's the cigarette burning rate would be different in each CCC, and could be made the same at relatively different positions in said CCC's. This makes it possible for a smoker to suitably alter the fixed combustion rate by placing the lit end of a cigarette closer or further away from the ashtray wall 50 alongside of a suitable curved CCC surface 28 of the cigarette receiving channel; such that, the exit and entrance of various gases participating in the combustion process is enhanced or restricted, and therefore suitably controlling the cigarette self combustion rate.

As illustrated in FIG. 3 for example, when a burning tip 72 of a cigarett 70 is further away from the ashtray wall 50, a suitable groove 60 located at the bottom of the CCC 20–26 has an inhibited outflow of by-product gases heavier than air through a variable opening 62 formed by said groove 60, cigarette 70, curved CCC surface 28, and the ashtray wall 50; as well as, a controlled inflow of oxygen through a notch 80 in the ash tray wall 50. The inflow of oxygen through said notch 80 is controlled in part by the position of the cigarette in the CCC, the size of the notch 80, a volume of negative pressure around the burning tip of the cigarette caused by escaping gaseous combustion by-products heavier than air through the groove 60 and the space between the cigarette and the curved CCC surface 28, and rising gaseous combustion by-products lighter than air with hot ambient air due to the fact that hot gas mixture is lighter than cold gas mixture. The movements of gases is indicated tentatively by arrows in FIG. 3

However, as illustrated in FIG. 3, when the burning tip 72 of the cigarette is closer to the ashtray wall 50, the variable opening 62 has much smaller area such that the inflow, outflow, and circulation of said gases is altered sufficiently to result in a more inhibited combustion process for the cigarette.

This combined action of the fixed CCC burning rate and the variable burning rate selected by the smoker through the placement of the cigarette is the essence of the invention usefulness allowing the smoker to select the cigarette self burning rate or smoldering according to personal preference at different environmental conditions. For example, when the SATCCC is to be used outdoors in the wind, a smoker may further restrict the self burning rate to compensate for the effect of the wind on the CCC design parameters by simply placing the burning tip 72 of the cigarette much closer to the ashtray wall 50. This action also prevents the cigarette from being blown out of the SATCCC by the wind, a problem not solved by conventional ashtray designs.

FIG. 4 illustrates respectively the average difference of self burning rates between a cigarette in a conventional ashtray in FIG. 4*a*, and the smokeless ashtray with a controlled combustion chamber (SATCCC) in FIG. 4*b*, after approximately seven minutes of uninterrupted burning and proportional generation of second hand smoke.

FIG. 5 illustrates three of many design alternatives covered by the invention for a set of CCC 20–26, where in the invention one or more of similar or different sets may be incorporated. FIG. 5*a* shows a controlled combustion chamber (CCC) with a relatively inhibited self burning rate due to the extension of the cross-section-area of the curved CCC surface 28, the average size of the cross-section-area of the groove 60, and the average size of the cross-section-area of the noth 80. FIG. 5*b* shows a controlled combustion chamber (CCC) 20–26 with a different self burning rate due to the reduced and different curvature of the cross-section-area of the curved CCC surface 28, slightly larger size of the cross-section-area of the notch 80, and a very small size of the cross-section-area of the groove 60, as compared to the CCC in FIG. 5*a*. FIG. 5*c* shows a controlled combustion chamber (CCC) 20–26 and in comparison with FIG. 5*a*, this CCC has the cross-section-area of the the curved CCC surface 28 of the same curvature as the cigarette 70 but not extending over the height of the cigarette 70. Furthermore, the size of the cross-section-area of the groove 60 is much larger, and the size of the cross-section-area of the notch 80 is much smaller.

FIG. 3 and FIG. 5 illustrate together that, there are essentially five different elements which control the self burning rate of a cigarette 70. In FIG. 3 it is the variable opening 62 which limits the outflow of gases through the groove 60; and, in FIG. 5 it is the cross-section-areas of: the curved CCC surface 28, the suitable groove 60, and the suitable notch 80. Furthermore, as illustrated in FIG. 2, the groove 60 is suitably slanted downward from the ashtray wall 50 to the edge of the SATCCC; such that, the cross-section-area of the groove 60 is small and large respectively. This allows the earth's gravity to play an essential role in removing the gaseous combustion by-products heavier than air through said groove 60 and said variable opening 62.

The smokeless ashtray with controlled combustion chambers may also be made using suitable combination of materials; for example, the body 10 may be made with a suitable plastic, and the controlled combustion chambers 20–26 may be made out of metal to prevent burning of plastic.

The embodiments of the invention in which an exclusive property or privilege is claimed are defined as follows:

1. A smokeless ashtray comprising:

a body having a top surface and a bottom surface, the top surface having an ash receiving cavity recessed therein having a sidewall;

at least one controlled combustion chamber integrated with said top surface comprising a cigarette receiving channel having a curved surface and a groove in said surface extending along the length of said channel;

a first end of said channel being in communication with said ash receiving cavity via a notch in said sidewall of said cavity;

said groove having a depth which increases along the length of said channel from said first end to the opposite end thereof, such that the combustion rate of a lit cigarette placed in said channel may be adjusted by adjusting the position of the cigarette along the length of said channel.

* * * * *